US009279246B2

(12) United States Patent
Bronner

(10) Patent No.: US 9,279,246 B2
(45) Date of Patent: Mar. 8, 2016

(54) TWIST ON WIRE TIE WALL CONNECTION SYSTEM AND METHOD

(76) Inventor: Joseph Bronner, Warren, NJ (US)

( * ) Notice: Subject to any disclaimer, the term of this patent is extended or adjusted under 35 U.S.C. 154(b) by 571 days.

(21) Appl. No.: 12/853,031

(22) Filed: Aug. 9, 2010

(65) Prior Publication Data

US 2011/0061333 A1 Mar. 17, 2011

Related U.S. Application Data

(60) Provisional application No. 61/276,368, filed on Sep. 11, 2009.

(51) Int. Cl.
*E04B 1/41* (2006.01)

(52) U.S. Cl.
CPC ..... *E04B 1/4178* (2013.01); *E04B 1/4185* (2013.01)

(58) Field of Classification Search
CPC ..... E04B 1/4178; E04B 1/4185
USPC ..... 52/379, 410, 513, 712, 714; 223/88, 96
See application file for complete search history.

(56) References Cited

U.S. PATENT DOCUMENTS

| | | | | | |
|---|---|---|---|---|---|
| D15,622 | S | * | 12/1884 | Preble | D8/395 |
| 577,002 | A | * | 2/1897 | Blodgett | 52/712 |
| 589,481 | A | * | 9/1897 | Raywood et al. | 52/714 |
| D31,136 | S | * | 7/1899 | Wagor | D8/384 |
| 702,944 | A | * | 6/1902 | Hanshill | 52/712 |
| 770,616 | A | * | 9/1904 | Waite | 52/562 |
| 819,869 | A | * | 5/1906 | Dunlap | 52/714 |
| 1,139,908 | A | * | 5/1915 | Salkeld | 24/533 |
| 1,226,954 | A | * | 5/1917 | Easterday | 52/714 |
| 1,355,376 | A | * | 10/1920 | Arseneau | 24/499 |
| 1,388,100 | A | * | 8/1921 | Davis | 70/458 |
| 1,434,915 | A | * | 11/1922 | Scholfield | 52/454 |
| 1,462,205 | A | * | 7/1923 | Korns | 70/458 |
| 1,500,832 | A | * | 7/1924 | Ludwik | 52/719 |
| 1,568,997 | A | * | 1/1926 | Blount | 52/302.3 |
| 1,681,634 | A | * | 8/1928 | Binder | 52/391 |
| 1,798,134 | A | * | 3/1931 | Danielson | 52/379 |
| 1,807,898 | A | * | 6/1931 | Davidson | 256/57 |
| 1,859,353 | A | * | 5/1932 | Boone | 223/92 |
| 1,871,809 | A | * | 8/1932 | Lampert | 52/688 |
| 2,046,654 | A | * | 7/1936 | Rosen | 223/88 |
| 2,058,148 | A | * | 10/1936 | Hard | 52/714 |
| 2,201,360 | A | * | 5/1940 | Beckwith | 24/598.6 |
| 2,279,934 | A | * | 4/1942 | Wisecup | 24/345 |
| 2,319,129 | A | * | 5/1943 | Hamilton | 52/714 |
| 2,558,910 | A | * | 7/1951 | Peacock, Sr. | 223/85 |
| 2,590,633 | A | * | 3/1952 | Lucas | 43/42.09 |

(Continued)

FOREIGN PATENT DOCUMENTS

FR 1393435 A * 3/1965

OTHER PUBLICATIONS

Machine Translation of FR 1393435 A from EPO's website; last accessed on Jun. 18, 2014.*

*Primary Examiner* — Charles A Fox
*Assistant Examiner* — Charissa Ahmad
(74) *Attorney, Agent, or Firm* — Quarles & Brady LLP

(57) ABSTRACT

A wire tire includes an embedment end having first and second ends. First and second leg portions extend from the first and second ends, respectively. First and second moment arms extend from the first and second leg portions, respectively. First and second hook arms extend from the first and second moments arms, respectively.

19 Claims, 18 Drawing Sheets

(56) References Cited

U.S. PATENT DOCUMENTS

| | | | | | |
|---|---|---|---|---|---|
| 2,634,030 | A | * | 4/1953 | Hershberger | 223/74 |
| 2,648,471 | A | * | 8/1953 | Helwig | 223/96 |
| 2,811,162 | A | * | 10/1957 | Brody | 132/323 |
| 2,868,389 | A | * | 1/1959 | Friend | 211/123 |
| 2,877,940 | A | * | 3/1959 | Pressler | 223/88 |
| 3,234,616 | A | * | 2/1966 | Wantland | 24/543 |
| 3,302,348 | A | * | 2/1967 | Pratt | 52/223.8 |
| 3,309,830 | A | * | 3/1967 | Fitzgerald | 52/513 |
| 3,530,545 | A | * | 9/1970 | Lengyel | 248/690 |
| 3,633,253 | A | * | 1/1972 | Ellis | 24/552 |
| 3,831,826 | A | * | 8/1974 | Thomas | 223/88 |
| 4,021,990 | A | * | 5/1977 | Schwalberg | 52/479 |
| 4,598,518 | A | | 7/1986 | Hohmann | |
| 4,667,913 | A | * | 5/1987 | Peelle et al. | 248/228.7 |
| 4,819,401 | A | * | 4/1989 | Whitney, Jr. | 52/713 |
| 5,063,722 | A | | 11/1991 | Hohmann | |
| D367,389 | S | * | 2/1996 | Cole et al. | D6/580 |
| 5,634,310 | A | * | 6/1997 | Hohmann | 52/513 |
| 5,729,870 | A | * | 3/1998 | Sharp | 24/3.6 |
| 5,913,341 | A | * | 6/1999 | Jones | 140/119 |
| 6,128,882 | A | * | 10/2000 | Jones | 52/665 |
| 6,817,147 | B1 | * | 11/2004 | MacDonald | 52/220.7 |
| 6,925,768 | B2 | | 8/2005 | Hohmann et al. | |
| 6,941,717 | B2 | | 9/2005 | Hohmann et al. | |
| D600,102 | S | * | 9/2009 | Larkin | D8/370 |
| 7,587,874 | B2 | * | 9/2009 | Hohmann, Jr. | 52/714 |
| 7,650,770 | B2 | * | 1/2010 | Maxwell | 70/408 |
| 7,966,784 | B2 | * | 6/2011 | Wobber | 52/513 |
| D645,731 | S | * | 9/2011 | Williams | D8/370 |
| 8,037,653 | B2 | * | 10/2011 | Hohmann, Jr. | 52/379 |
| 8,096,090 | B1 | * | 1/2012 | Hohmann et al. | 52/513 |
| 2007/0062138 | A1 | * | 3/2007 | Wobber | 52/379 |

* cited by examiner

TWIST ON WIRE TIE WALL CONNECTION SYSTEM AND METHOD

CROSS REFERENCE TO RELATED APPLICATIONS

This application claims the benefit of U.S. Provisional Application Ser. No. 61/276,368, filed Sep. 11, 2009, and incorporated herein by reference in its entirety.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to an apparatus for transferring horizontal loads between a back-up structure and a veneer wall and, more particularly, to a twist on wire tie that connects a veneer wall to an anchor or anchor rail, which is attached to the back-up structure.

2. Description of the Background of the Invention

Much of today's construction of buildings requires a structural back-up wall to support horizontal transverse loads exerted by masonry veneer wall. The back-up wall typically consists of stud wall, masonry wall, concrete wall, steel elements etc. The veneer wall is supported horizontally by the back-up wall via masonry ties embedded in mortar joints on one end and attached to an anchor or a vertical anchor rail on the other end. The anchor rail is connected to the back-up wall and should be able to transfer the horizontal transverse loads, whether applied in tension or in compression, to the back-up wall.

Known wire ties used for connecting a rubble stone veneer wall include a common wire tie 30 of the type shown in FIG. 1. The wire tie 30 includes a connector plate 32 permanently attached thereto by either a crimping or welding procedure. This wire tie 30 is sold by Hohman & Barnard, Inc. of Hauppauge, N.Y., under the name "Tie-HVR-195V" System. Turning to FIG. 2, the wire tie 30 is shown connecting a veneer wall 34 to a back-up wall 36 for load transfer between the walls 34, 36. Connecting the walls 34, 36 with the wire tie 30 improves the structural stability of the wall 34, making the veneer wall resistant to a variety of forces acting on the wall, e.g., wind forces pushing the veneer wall 34 toward the back-up wall 36 or forces acting in other directions. Still referring to FIG. 2, the wire tie 30 is connected to the back-up wall 36 by lifting a rail 38 upwardly out of an anchor loop 40. Thereafter, a worker slides an end 42 of the rail 38 into an opening 44 (see FIG. 1) of the wire tie 30. Generally, the next steps include placing an embedment end 46 of the wire tie 30 into a mortar bed 48 of the veneer wall 34 and then installing a block 50 on top of the mortar bed 48. When the mortar cures, the wire tie 30 is a rigid connection point for load transfer between the walls 34, 36.

The wire tie 30 shown in FIGS. 1 and 2 has considerable drawbacks. First, the anchor rail 38 must be slid out of the anchor loop 40 to insert the rail 38 through the opening 44 of the wire tie's 30 connector plate 32. It is not practical to add another wire tie 30 onto the anchor rail 38 after installation has occurred. The new wire tie described herein may be inserted onto a round anchor rail without removing same from the corresponding anchor loops. The new wire tie can also be front loaded at practically any level without threading it through an end of the anchor rail, which saves time and money during installation. Another problem with the prior art wire tie 30 is that it does not provide a rigid connection between the wire tie 30 and the connector plate 32, which allows the wire tie 30 to deflect excessively under compression load. The new wire tie described herein is less costly to manufacture, does not require the use of a connector plate, and resists both tensile and compressive forces.

Referring to FIG. 3, another known wire tie 52 is shown, which includes a cross bar 54 welded thereto between opposing leg portions. The cross bar 54 and a closed end 56 define an opening therebetween to accommodate the anchor rail 36 described hereinabove. The wire tie 52 is sold by Dur-O-Wal, Inc. of Aurora, Ill., under product number DA3000SL. The prior art wire tie 52 suffers from similar drawbacks as identified in connection with the prior art wire tie 30, i.e., it is not practical to add another wire tie 52 after the anchor rail 38 is installed within the anchor loops 40 and that the wire tie 52 must be inserted onto the rail 38 at the end 42 thereof. The wire tie 52 also includes the additional manufacturing step of adding a cross bar 54.

Another known wire tie 60 for connecting a masonry veneer wall to a back-up wall is shown in FIGS. 4 and 5. The prior art wire tie 60 is sold by Heckmann Building Products of Melrose Park, Ill., and is marked in their catalog as product #'s 314, 316, and 318. The wire tie 60 includes the embedment end 46 (noted above), two opposing legs, and a closed end 62. The wire tie 60 is connected to an anchor rail 64. A worker installs the wire tie 60 by inserting an end 66 of the wire tie 60 into a space between the anchor rail 64 and a surface of a back-up wall 68. The end 66 is rotated approximately one hundred eighty degrees so that the closed end 62 of the wire tie 60 is disposed in the space between the anchor 64 and the back-up wall 68. The embedment end 46 is then ultimately disposed in a mortar bed (not shown).

The prior art wire tie 60 also has significant drawbacks. In instances where there is a tight working space to install wire ties, a worker may find it difficult or impossible to loop and rotate the wire tie 60 into the anchor rail 64. This issue may become more exacerbated when anchor rails with wider channels and/or multiple slots are utilized (see below). The new wire tie described herein overcomes such disadvantages by the ease of front loading the wire tie, which will be described with greater particularity below.

Similar wire ties as those shown in FIGS. 1-5 are also sold by most other wire tie manufacturers, which suffer from the same issues as noted above. The present invention provides for an improved wire tie that can be attached to certain types of vertical anchors and anchor rails in a more direct and efficient way than previous prior art wire ties. Additionally, the new wire tie will enable the development of new anchor rails, not practical till now, that will take advantage of the new properties found in the present wire tie.

SUMMARY OF THE INVENTION

Wire ties for connecting a veneer wall to an anchor or anchor rail, which is attached to a back-up structure, are disclosed.

According to one aspect of the present invention, a wire tire includes an embedment end having first and second ends. First and second leg portions extend from the first and second ends, respectively. First and second moment arms extend from the first and second leg portions, respectively. First and second hook arms extend from the first and second moments arms, respectively.

According to another aspect of the present invention, a method of securing a wire tie to an anchor includes the step of providing an anchor having a rail portion. Another step is the provision of a wire tie having first and second hook arms and first and second moment arms attached thereto, respectively, which define an aperture. The first and second hook arms at least partially overlap one another and are deflectable from one another. Other steps include positioning the first and second hook arms adjacent the anchor, deflecting the first and second hook arms from one another, and moving the wire tie so that the rail portion of the anchor is disposed within the aperture of the wire tie.

According to still another aspect of the present invention, a method of securing a wire tie to an anchor includes the step of providing an anchor having first and second rail portions. Another step is the provision of a wire tie having first and second hook arms and first and second moment arms attached thereto, respectively. Other steps include positioning the first and second hook arms between the first and second rail portions of the anchor and rotating the wire tie so that the first and second rail portions are received within the first and second hook arms.

DETAILED DESCRIPTION OF THE PREFERRED EMBODIMENTS

Figure 6:
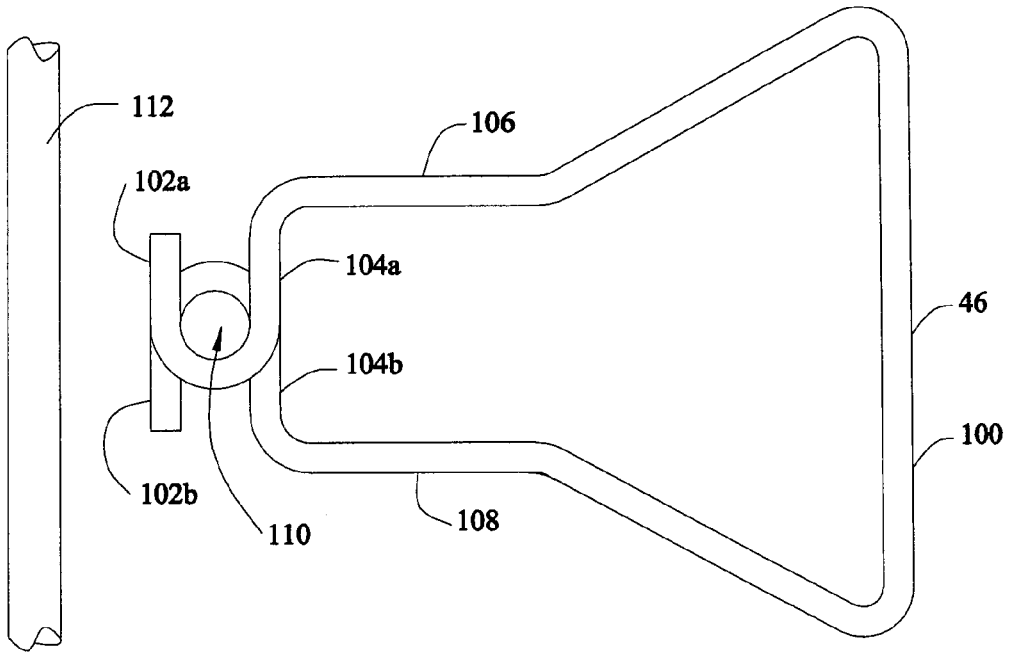
FIG. 6 is a side elevational view of an embodiment of a wire tie and a fragmentary side elevational view of an anchor rail.

Referring to FIG. 6, a wire tie 100 is shown, which includes hook arms 102*a*, 102*b* and moment arms 104*a*, 104*b*. Leg portions 106, 108 extend between the moment arms 104*a*, 104*b*, respectively, and the handle or embedment end 46. An aperture 110 is defined by portions of the wire tie 100 adjacent the hook arms 102*a*, 102*b* and the moment arms 104*a*, 104*b*. The wire tie 100 is adapted to be attached to a rail 112, which will be described in greater detail hereinbelow.

The wire tie 100 is preferably similar in thickness and other dimensions as the above noted prior art wire ties. For example, wire ties are generally made of 3/16 in. diameter steel wire, so that they can be embedded in a 3/8 in. thick mortar bed in compliance with particular building code requirements. In cases where a stronger wire tie is desired, the wire tie 100 may be made with a thicker diameter, e.g., 1/4 in. diameter wire, in which case the portion embedded in a mortar bed may be flattened to be not more than 3/16 in. thick to comply with particular building codes requirements. The planar dimensions of the wire tie vary widely depending upon the wall construction and may be modified accordingly to suit the user's desired needs. In one typical example, the wire tie 100 will bridge a 2 in. air space gap and be embedded about 2 in. within a veneer wall, which will make the wire tie 100 about 4 in. long. The straight portion of the embedment end 46 embedded within the mortar bed will be about 4 in. wide in this example. The wire ties are preferably made of carbon steel, which are coated to prevent corrosion, or from stainless steel. However, it is anticipated that other types of materials known to one of skill in the art may be used as well.

With reference to FIGS. 6-9, the presently contemplated wall connection procedure is shown, which may be generally described as a front-load and twist procedure. The wire tie 100, as noted above, includes hook arms 102*a*, 102*b*, which are deflectable in a direction substantially perpendicular to a plane of the wire tie 100 represented by the arrow A. During installation, a worker grasps the handle end or embedment end 46 and pushes the hook arms 102*a*, 102*b* against the rail 112. The application of a sufficient compressive force will cause the hook arms 102*a*, 102*b* to deflect or spread apart from one another (see FIG. 8) about the rail 112. It may be seen that the deflectable hook arms 102*a*, 102*b* allow for the wire tie 100 to be connected to the rail 112 without the need for removing the rail 112 from a back-up wall 114. The continuing application of the compressive force causes the hook arms 102*a*, 102*b* to be pushed beyond greatest width portions of the rail 112 and placed in a position depicted in FIG. 7.

During the wall connection procedure, the worker may spread the hook arms 102*a*, 102*b* apart during or prior to engagement with the rail 112 manually or using a suitable tool. Preferably, however, the wire tie 100 is manufactured with sufficient resiliency to allow a worker to manually install the wire tie 100 without the need for tools. Further, under normal conditions the deformation of the wire tie 100 is elastic, so that the hook arms 102*a*, 102*b* will spring back to their original position without any damage to the wire tie 100. This spring action is possible because of the relationship between the wire tie's 100 material properties, the wire tie's 100 dimensions, and the required deformation of the hook arms 102*a*, 102*b* for placement onto an anchor rail.

Figure 9:
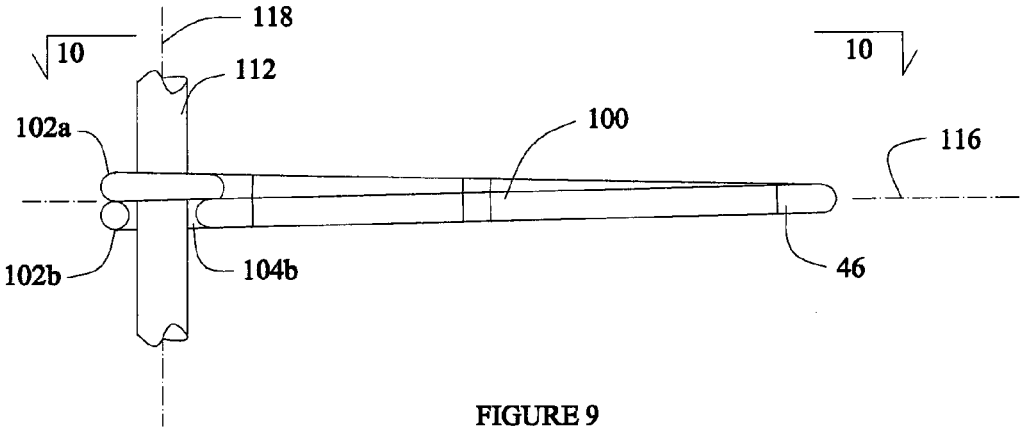
FIG. 9 is a fragmentary side elevational view of the wire tie and anchor rail of FIG. 6 in a second installation position.

In the present embodiment, the overlapping hook arms 102*a*, 102*b* are manufactured to be approximately 1/16 in. to 1/8 in. apart (see FIGS. 6 and 9). Other materials or manufacturing processes may be used to create smaller or no spacing between the hook arms 102*a*, 102*b* in any of the embodiments disclosed herein. However, spacing the hook arms 102*a*, 102*b* apart provides the additional advantage of allowing a protective coating, e.g. a hot dip galvanizing coating or corrosion resisting coating, to be applied to the hook arms 102*a*, 102*b* and other portions of the wire tie 100 without interruption.

Figure 7:
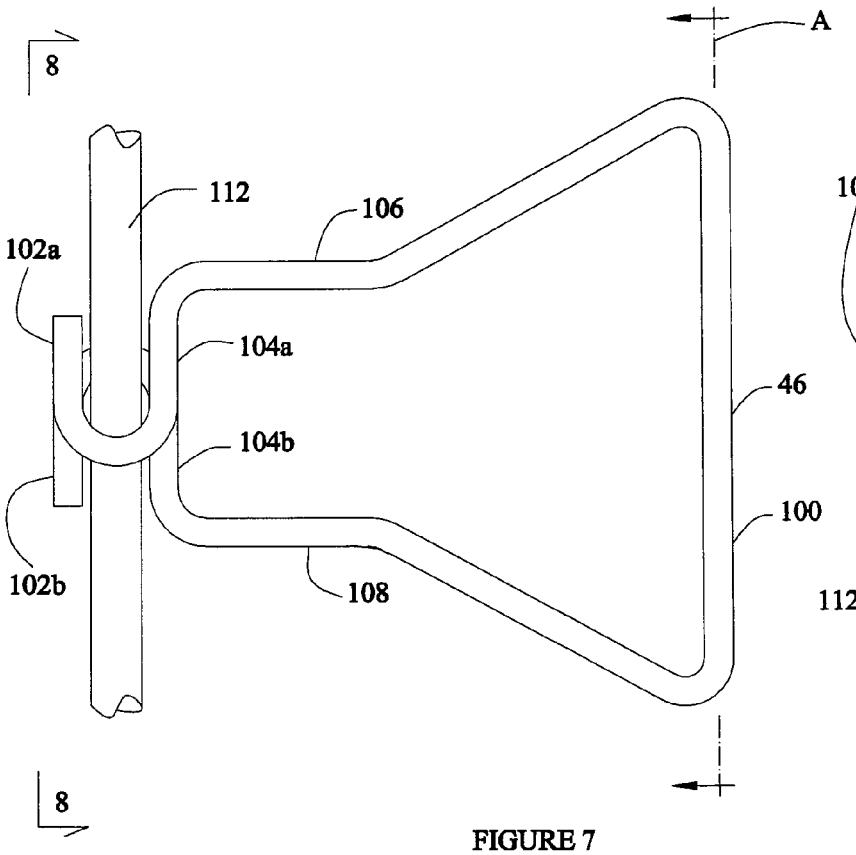
FIG. 7 is a fragmentary side elevational view of the wire tie and anchor rail of FIG. 6 in a first installation position.
Figure 8:
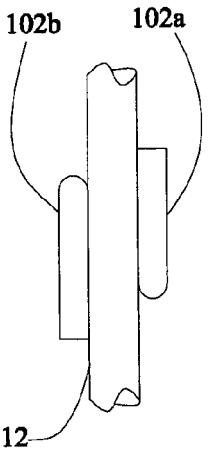
FIG. 8 is a fragmentary front elevational view of the wire tie and anchor rail of FIG. 7 taken along site line 8-8.
Figure 10:
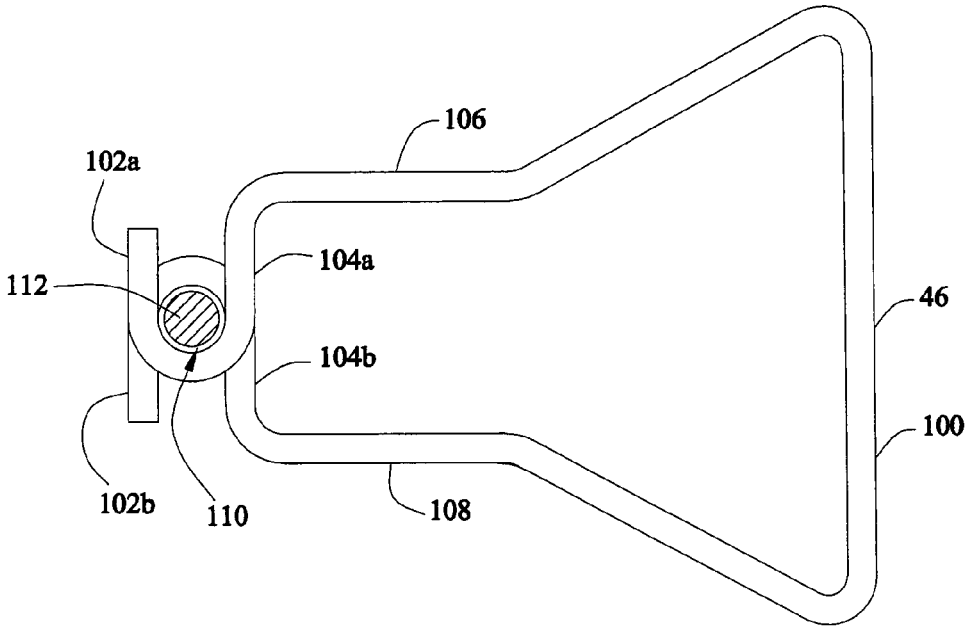
FIG. 10 is a top plan view, partly in section, of the wire tie and anchor rail of FIG. 9 taken along site line 10-10 thereof.
Figure 11:
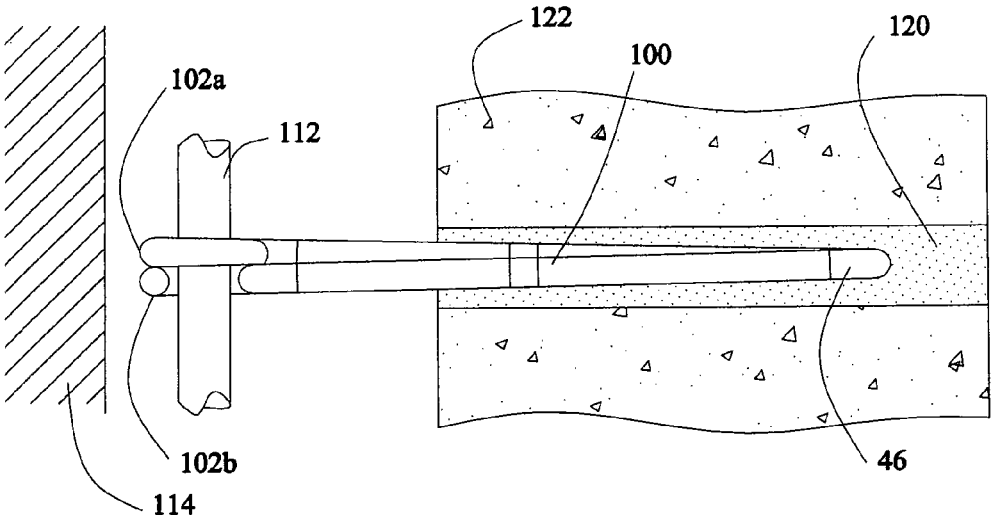
FIG. 11 is a fragmentary elevational view, partly in section, of the wire tie and anchor rail of FIG. 9, further showing the wire tie partly embedded in a mortar joint of a veneer wall.

Once the wire tie 100 is in the position shown in FIG. 7, the worker rotates the wire tie 100 approximately 90 degrees about an axis 116 so that the plane A of the wire tie 100 is substantially perpendicular to a longitudinal axis 118 of the rail 112. For example, in the present embodiment the handle end 46 is rotated clockwise about the axis 116 until the plane A of the wire tie 100 is substantially perpendicular to the longitudinal axis 118 of the rail 112 as shown in FIG. 9. Turning to FIG. 10, it may be seen that the rail 112 is captured within the aperture 110 between the hook arms 102*a*, 102*b* and the moment arms 104*a*, 104*b*. Referring to FIG. 11, when the embedment end 46 of the wire tie 100 is disposed within a mortar joint 120, the wire tie 100 is a secure connection between a veneer wall 122 and the back-up wall 114. It should be noted that the wire tie 100 could be modified by one skilled in the art so that counter-clockwise rotation would effect installation. This would require modifying the hook arms 102*a*, 102*b* so that if one were viewing FIG. 7, the hook arm 102*a* would appear behind the rail 112 and the hook arm 102*b* would appear in front of the rail 112. It is also contemplated that in other embodiments the wire tie 100 may be adapted to be rotated more or less than 90 degrees to properly align the rail 112 within the aperture 110 of the wire tie 100.

Figure 1:
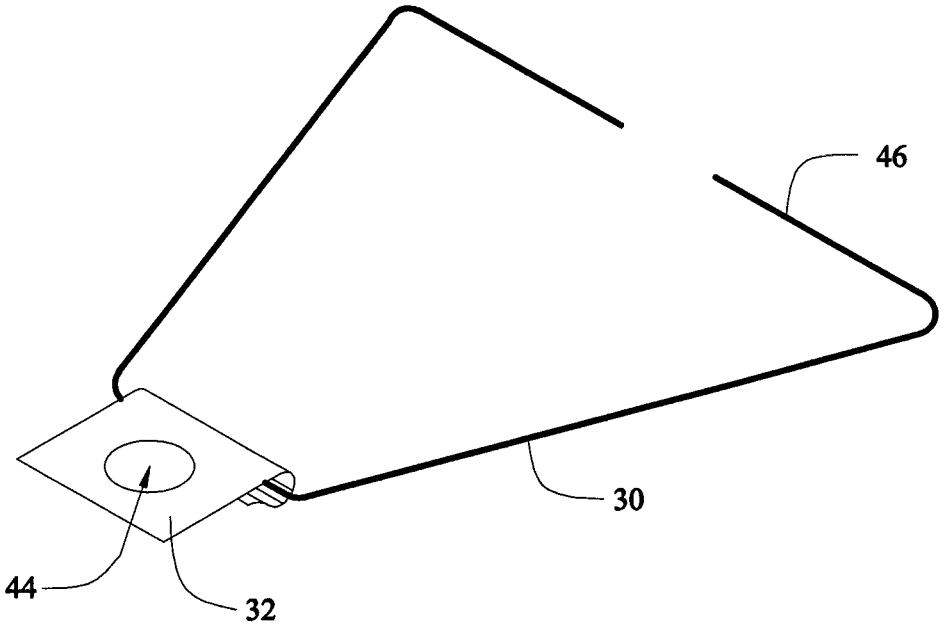
FIGURE 1 PRIOR ART
FIG. 1 is an isometric view of a prior art wire tie.
Figure 2:
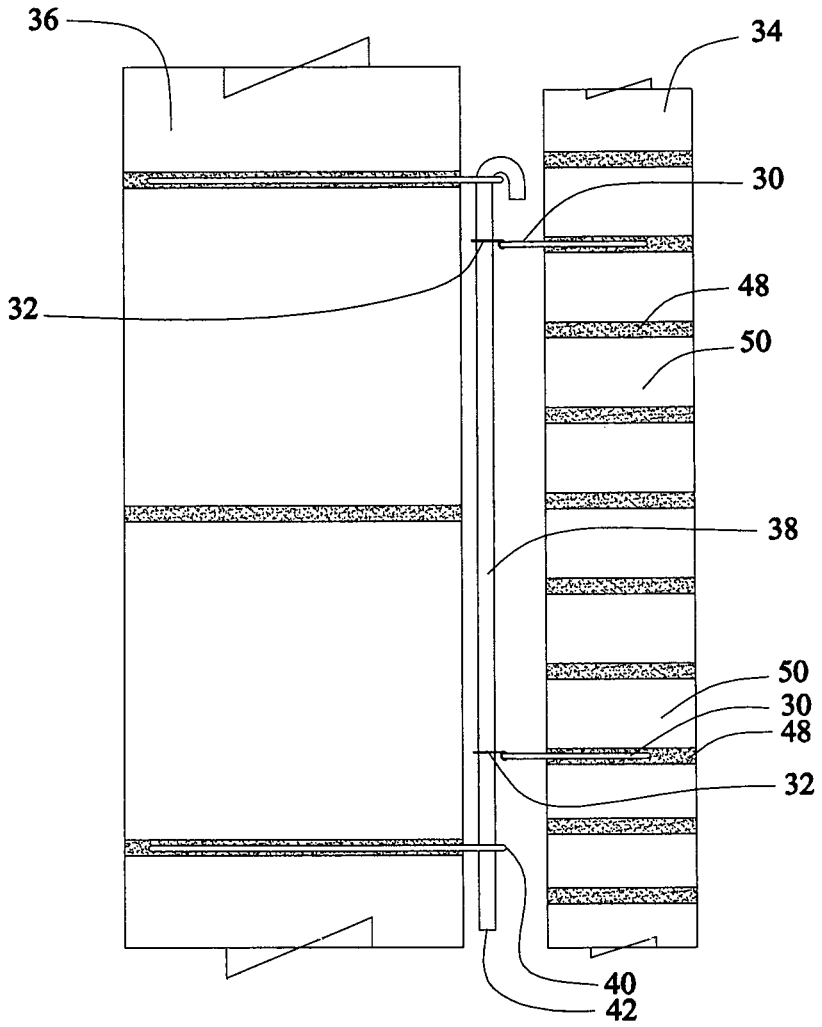
FIGURE 2 PRIOR ART
FIG. 2 is a fragmentary elevational view, partly in section, of a prior art connection system including the wire tie of FIG. 1.
Figure 3:
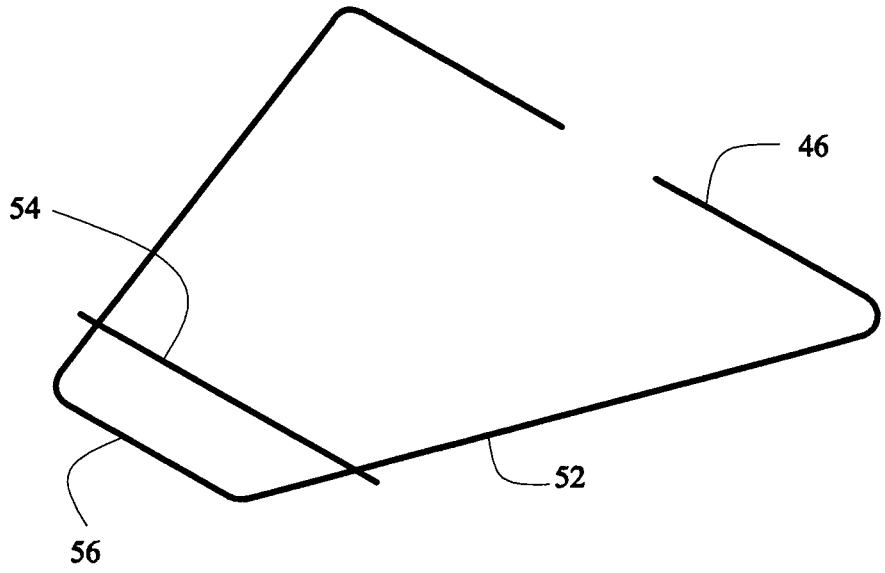
FIGURE 3 PRIOR ART
FIGS. 3 and 4 are isometric views of additional prior art wire ties.
Figure 4:
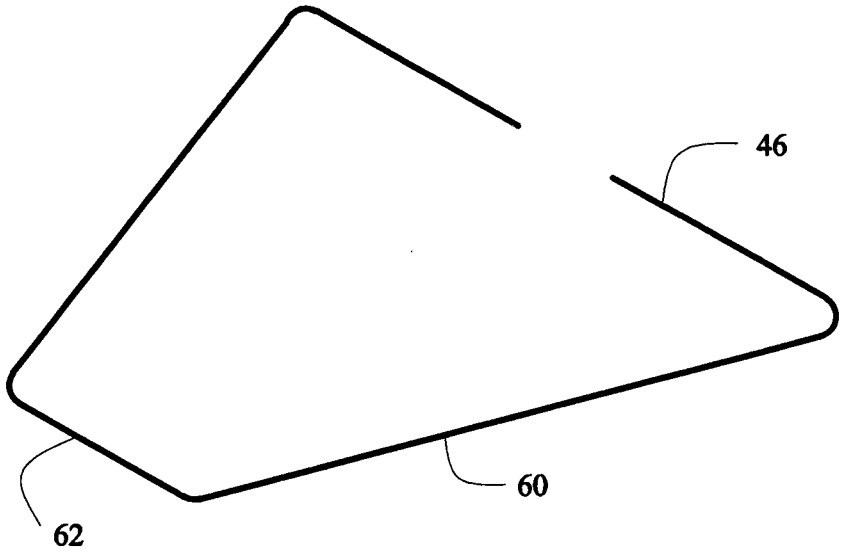
FIGURE 4 PRIOR ART
Figure 5:
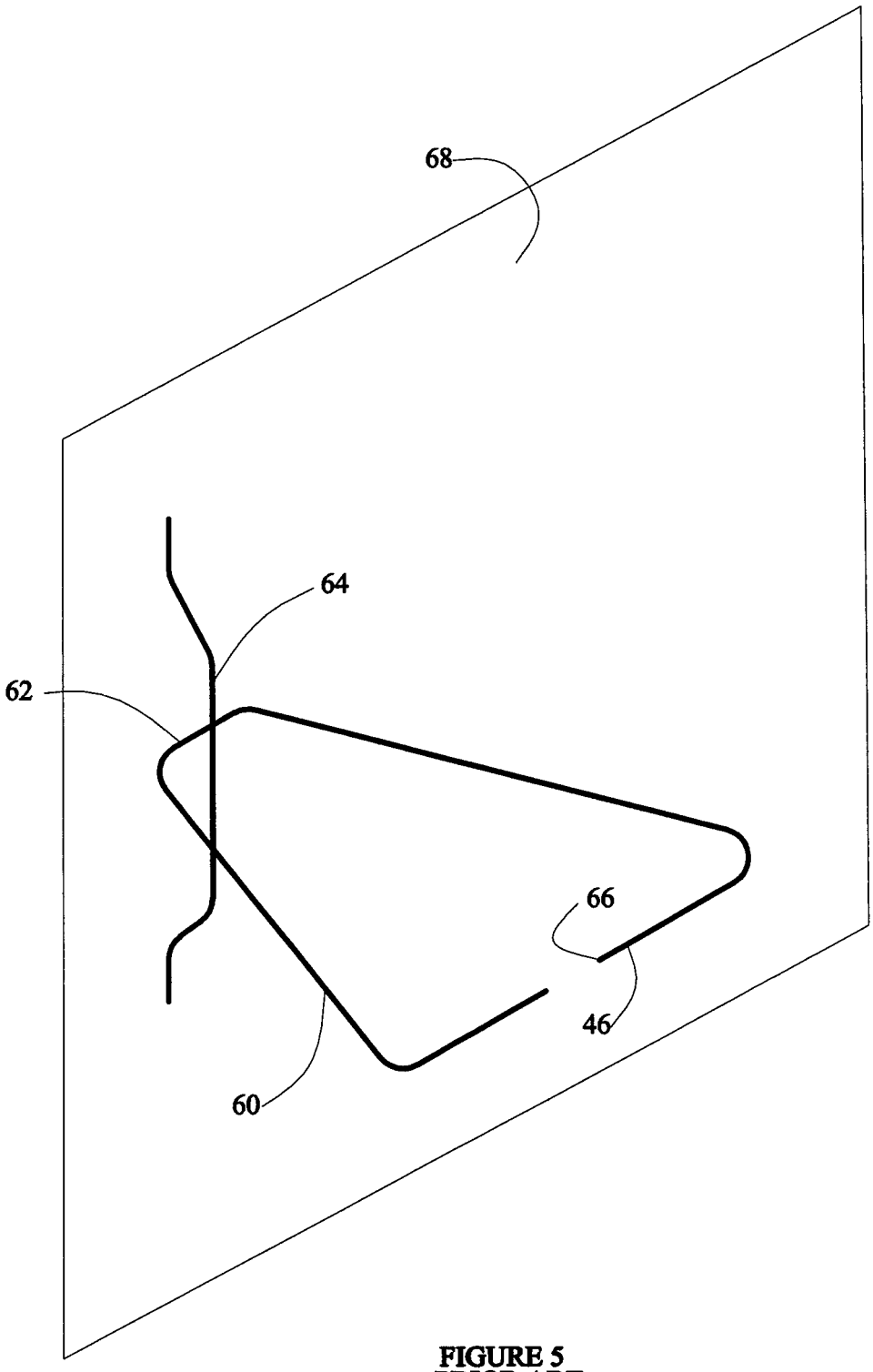
FIGURE 5 PRIOR ART
FIG. 5 is an isometric view of the prior art wire tie of FIG. 4 in combination with a prior art vertical anchor rail attached to a back-up wall shown schematically.
Figure 12:
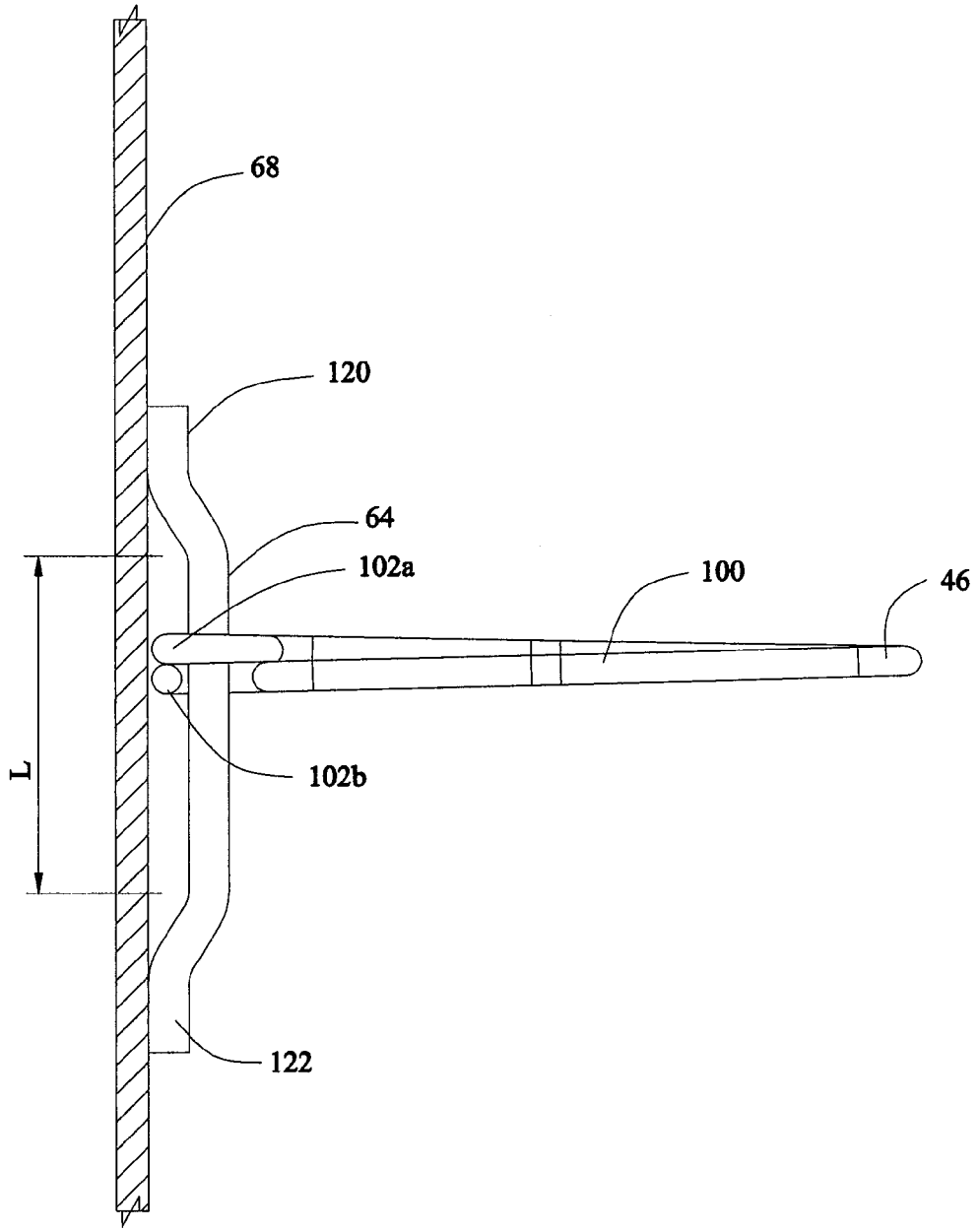
FIG. 12 is a fragmentary elevational view, partly in section, showing the wire tie of FIG. 6 attached to the prior art vertical anchor rail of FIG. 5.

Turning to FIG. 12, the wire tie 100 is shown installed to the back-up wall 68 via the anchor rail 64. As noted in connection with the prior art wire tie 60 (see FIGS. 4 and 5), the installation of such wire ties may be difficult or impossible in some situations where there is a tight working space. In instances where there is a tight working space, a worker may find it easier to install the wire tie 100 to the anchor rail 64 rather than the prior art wire tie 60. In this regard, as described in connection with FIGS. 6-9, the worker simply deflects the hook arms 102*a*, 102*b* apart and then rotates the wire tie 100 ninety degrees to effect installation.

With reference still to FIG. 12, the wire tie 100 is shown attached to the prior art vertical anchor rail 64. The anchor rail 64 is welded to the back-up wall 68 at ends 120, 122 thereof. The wire tie 100 is attachable at different points along length dimension L between the ends 120, 122. Providing this range of attachment along length dimension L is helpful because the height of a mortar bed from the ground may vary with respect to the height of the anchor rail 64 from the ground. This range of attachment points may be especially helpful when the veneer wall is made of irregularly sized stones such as with a stone rubble veneer wall (not shown). With such a wall, the height of the mortar bed relative to the anchor rail 64 likely varies more than construction of a veneer wall made of consistently sized blocks or stones. However, even consistently sized blocks are subject to some degree of unpredictability of mortar bed height relative to anchor rail height.

Figure 13:
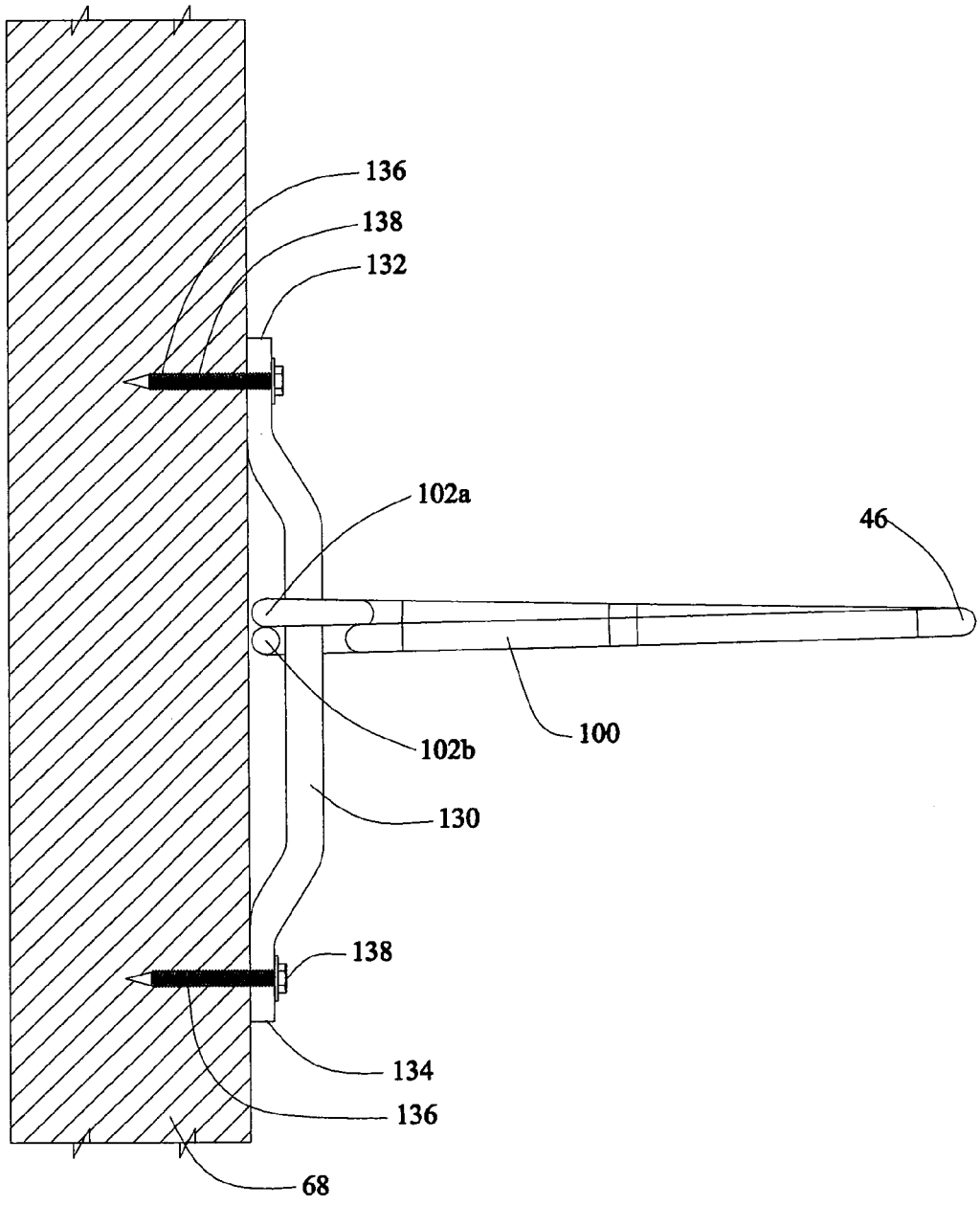
FIG. 13 is a fragmentary elevational view, partly in section, of the wire tie and anchor rail of FIG. 12, with a modification made to the anchor rail.
Figure 14:
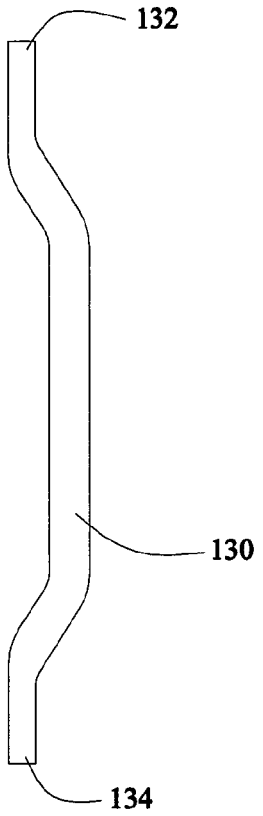
FIG. 14 is a side elevational view of the anchor rail shown in FIG. 13.
Figure 15:
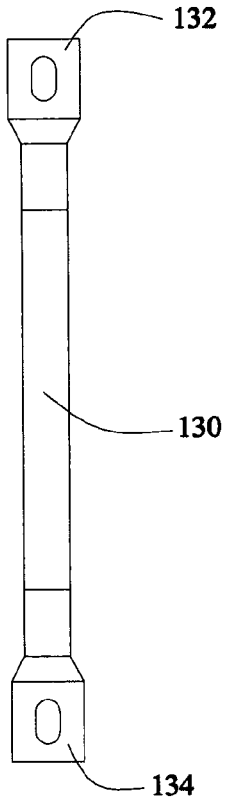
FIG. 15 is a front elevational view of the anchor rail shown in FIG. 13.

FIGS. 13-15 depict an anchor rail 130, which is similar to the prior art anchor rail 64 except for several modifications. The anchor rail 130 includes flattened ends 132, 134 that may be fastened to the hard surface back-up wall 68 using suitable fasteners 136, such as threaded screws 138.

Figure 16:
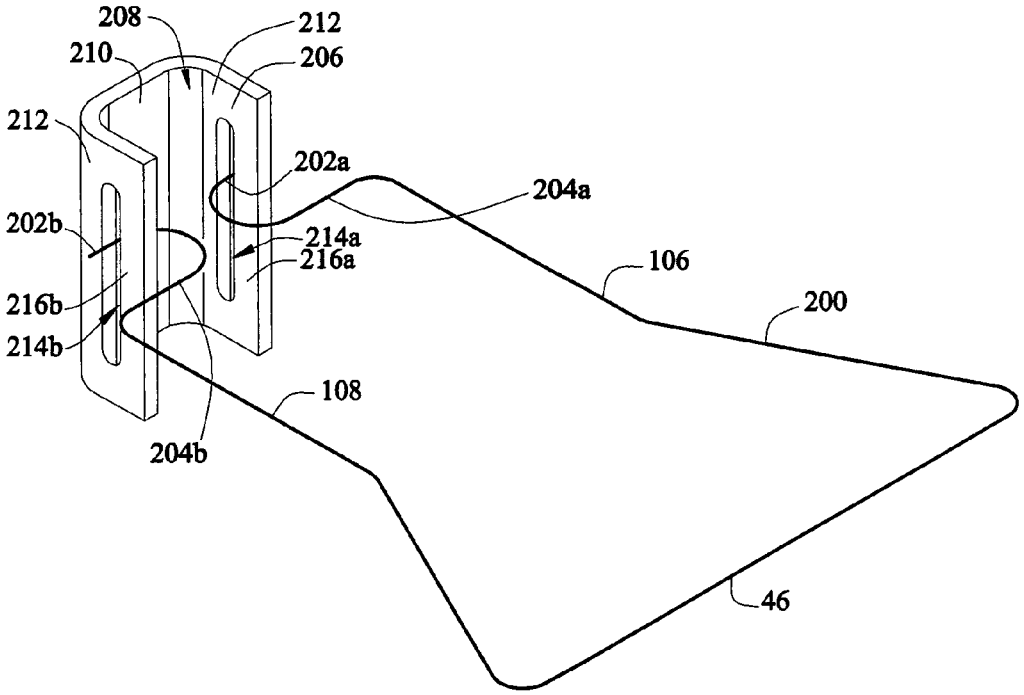
FIG. 16 is an isometric view of a second embodiment of a wire tie in combination with a slotted channel anchor.
Figure 17:
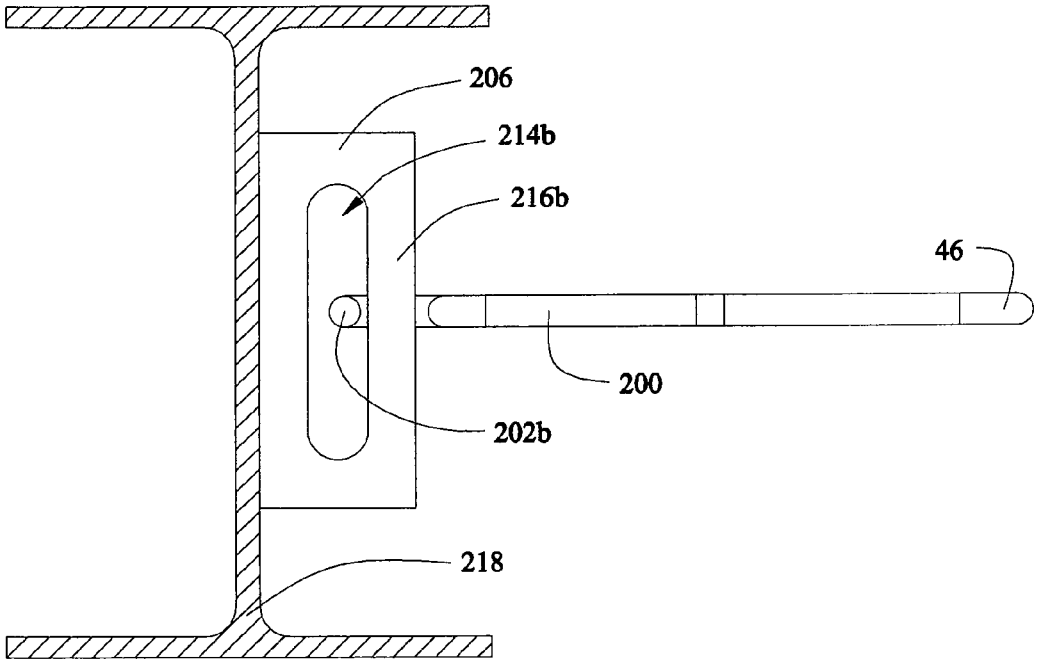
FIG. 17 is a side elevational view, partly in section, of the wire tie and slotted channel anchor of FIG. 16 in combination with a beam.

Referring to FIG. 16, a second embodiment of a wire tie 200 is shown, which is similar to the wire tie 100 except for the provision of side-by-side hooks 202*a*, 202*b* and side-by-side moment arms 204*a*, 204*b* as opposed to the overlapping hooks 102*a*, 102*b* and moment arms 104*a*, 104*b*, respectively, shown in FIG. 6. FIG. 16 also depicts an anchor 206, which comprises a U-shaped channel 208 defined by a back wall 210 and opposing side walls 212. The side walls 212 include opposing vertical slots 214*a*, 214*b* and capture rail portions 216*a*, 216*b*, respectively. The anchor 206 is adapted to be mounted on many support surfaces or back-up walls, e.g., FIG. 17 depicts the anchor 206 of FIG. 16 welded to a steel beam 218. Referring again to FIG. 16, the side hooks 202*a*, 202*b* may be secured within the vertical slots 214*a*, 214*b*, respectively, by positioning the wire tie 200 vertically so that a greatest length portion of the handle end 46, i.e., portions of the handle between the leg portions 106, 108, is parallel to a greatest length dimension of the anchor 206. The wire tie 200 is pushed inwardly so that portions of the side hooks 202*a*, 202*b* are within the U-shaped channel 208. Thereafter, the wire tie 200 is rotated approximately 90 degrees so that the side hooks 202*a*, 202*b* are positioned within the vertical slots 214*a*, 214*b* as illustrated in FIG. 16. In this position, the hook arms 202*a*, 202*b* and the moment arms 204*a*, 204*b* are captured between the opposing rail portions 216*a*, 216*b* of the anchor 206.

Figure 18:
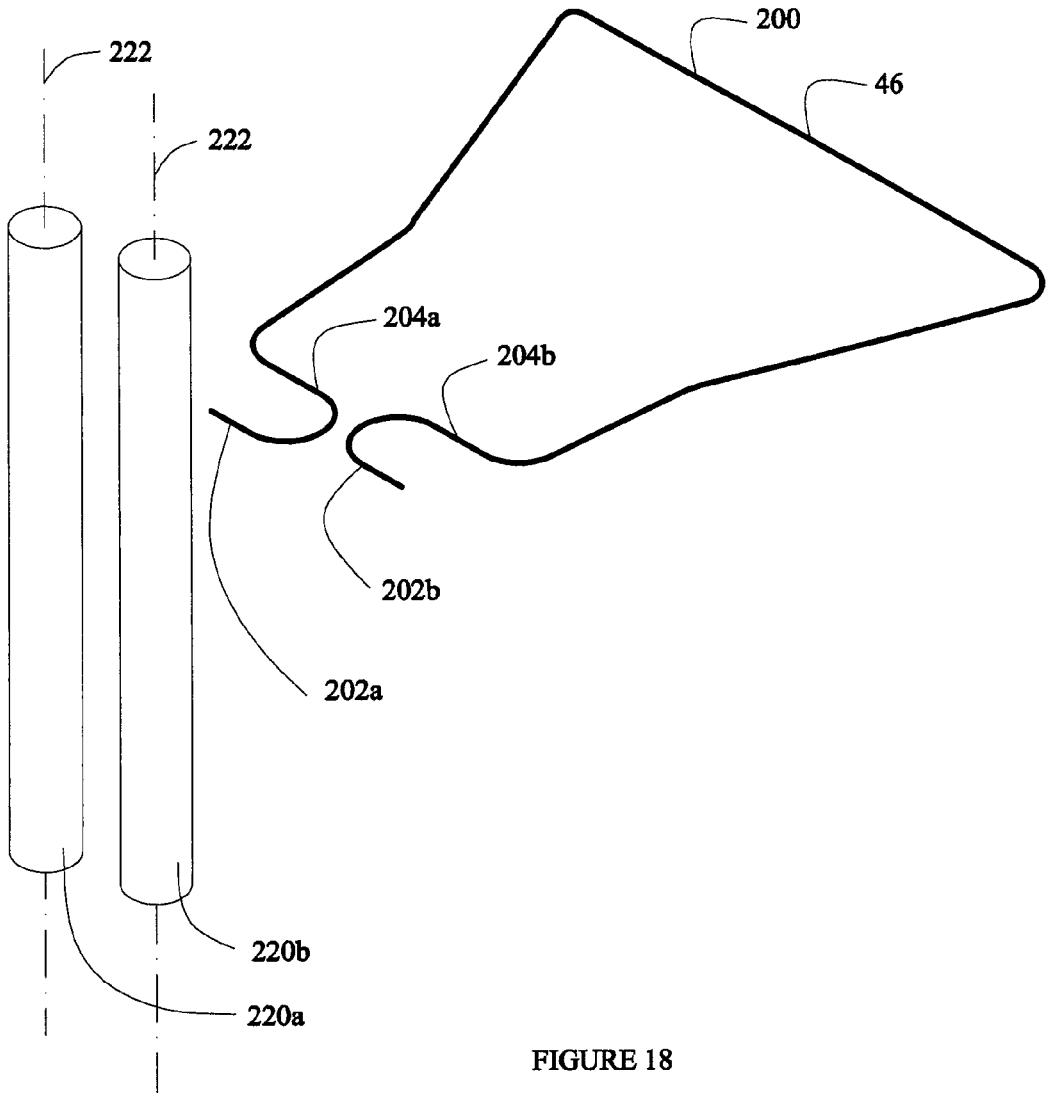
FIG. 18 is a further fragmentary isometric view of the wire tie of FIG. 16 in combination with a pair of rails.

Alternatively, FIG. 18 demonstrates that the side hooks 202*a*, 202*b* of the wire tie 200 may be secured to a pair of rails 220*a*, 220*b*, respectively. To attach the wire tie 200 to the rails 220*a*, 220*b*, the worker vertically orients the wire tie 200 in a manner discussed above in connection with FIG. 16, such that the greatest length portion of the handle 46 is parallel to a longitudinal axis 222 of the rails 220*a*, 220*b*. Next, the worker positions the hooks 202*a*, 202*b* between the rails 220*a*, 220*b* and thereafter rotates the wire tie 200 approximately ninety degrees. The rails 220*a*, 220*b* are thereby captured between the hook arms 202*a*, 202*b* and the moment arms 204*a*, 204*b*, respectively.

Figure 19:
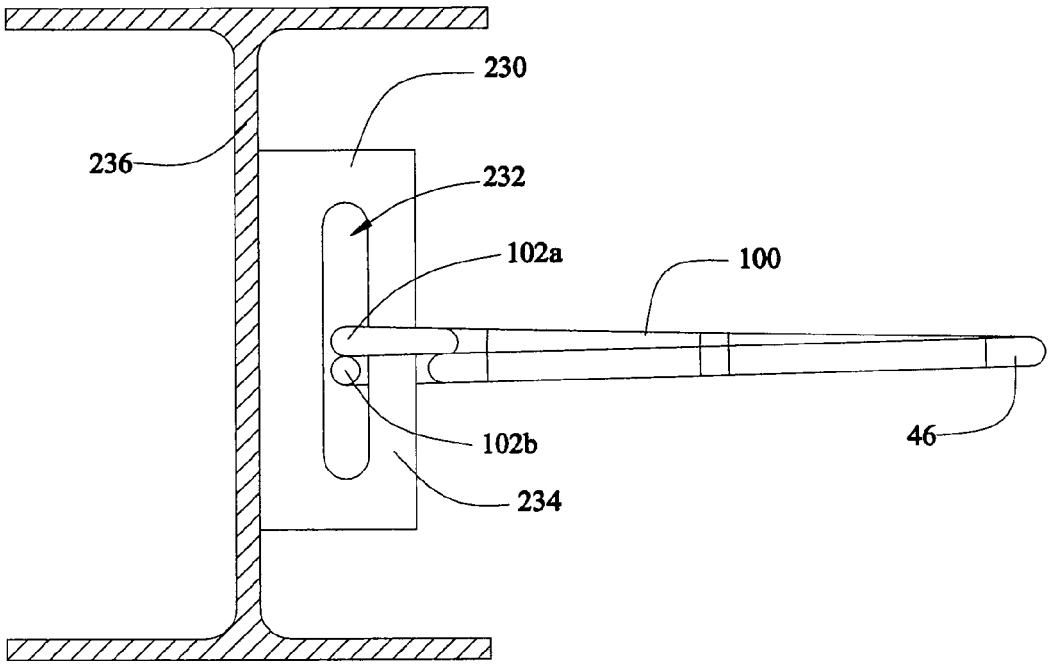
FIG. 19 is a side elevational view, partly in section, of the wire tie of FIG. 6 in combination with a prior art slotted plate anchor attached to a beam.

It is also contemplated that the wire tie 100 may be used in connection with conventional prior art anchors. For example, FIG. 19 shows an alternative prior art anchor 230 having an opening 232 and a rail portion 234. The wire tie 100 of FIG. 6 is attached to the anchor 230 in a similar manner as noted above. The anchor 230 is welded or otherwise secured to a steel beam 236.

Figure 20:
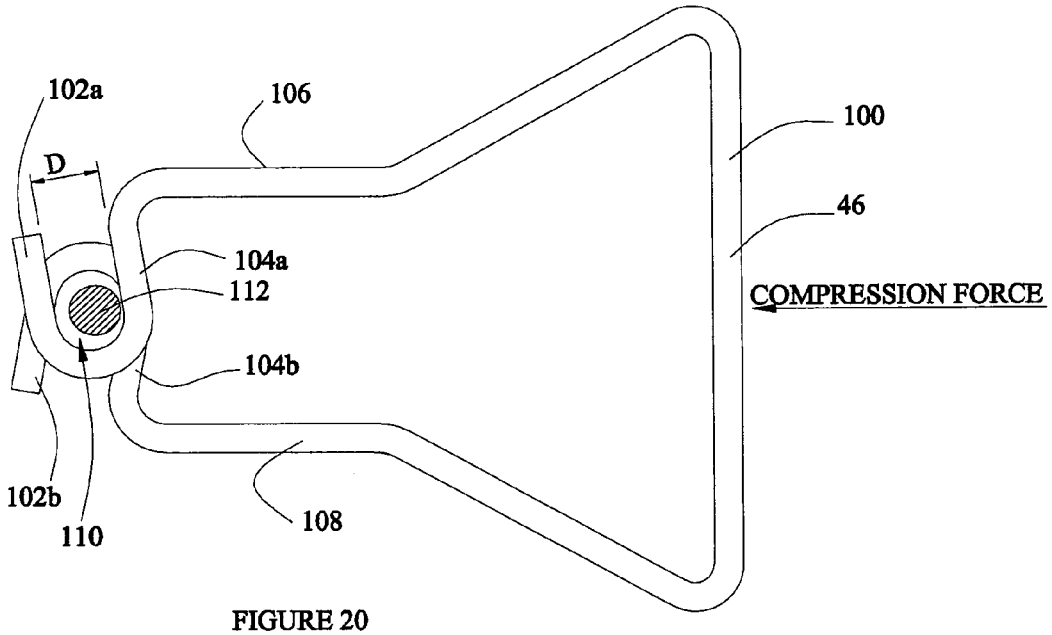
FIGS. 20 and 21 are top plan views, partly in section, of the wire tie and anchor rail of FIG. 6 deflecting in response to compression and tension forces, respectively.

Turning to FIG. 20, the wire tie 100 is shown deflecting in response to a compression force. The moment arm 104*a* bends toward the leg portion 106 and the moment arm 104*b* bends toward the leg portion 108. The wire tie 100 is constructed so that the bending moments in the hook arms 102*a*, 102*b* are smaller than the bending moments in the moment arms 104*a*, 104*b*. Therefore, the moment arms 104*a*, 104*b* bend significantly more in response to compression than the hook arms 102*a*, 102*b*. This allows the wire tie 100 to maintain a relatively constant distance D between the hook arms 102*a*, 102*b* and the moment arms 104*a*, 104*b*, respectively, so that the hook arms 102*a*, 102*b* continue to engage the rail 112 under compressive forces. Also, providing a pair of opposing hook arms 102*a*, 102*b* rather than one, further inhibits the hook arms 102*a*, 102*b* from disengaging from the rail 112 in a direction perpendicular to a compressive force and the rail 112 from sliding out of the aperture 110.

Figure 21:
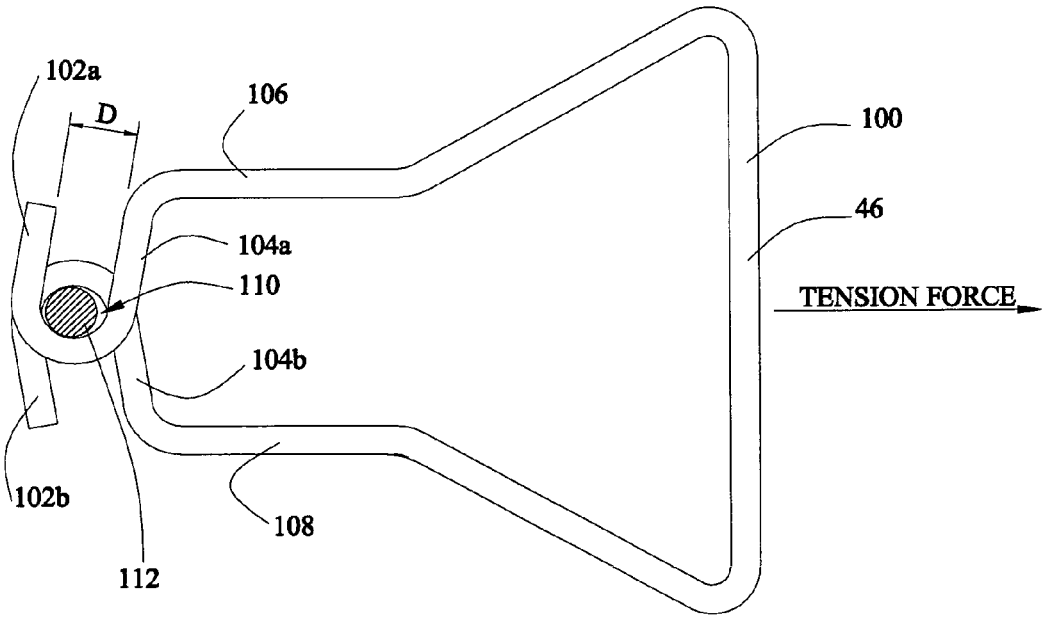

Similarly, FIG. 21 shows the effect of a tensile force on the wire tie 100. When tension is applied to the wire tie 100, the moment arm 104*a* bends away from leg portion 106 and the moment arm 104*b* bends away from leg portion 108. Because the hook arms 102*a*, 102*b* bend significantly less than the moment arms 104*a*, 104*b* the distance D is maintained approximately constant so that the rail 112 does not disengage or slide out of the aperture 110. Indeed, FIGS. 20 and 21 illustrate how tensile and compressive forces on the wire tie 100 may in fact cause the hook arms 102*a*, 102*b* to more deeply engage the rail 112.

Figure 22:
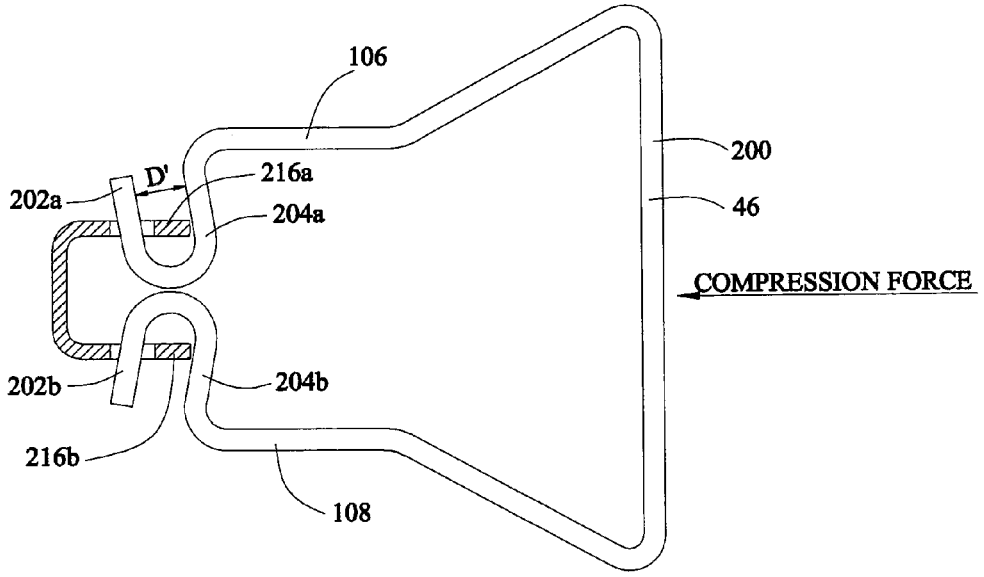
FIGS. 22 and 23 are top plan views, partly in section, of the wire tie and slotted channel anchor of FIG. 16 deflecting in response to compression and tension forces, respectively.
Figure 23:
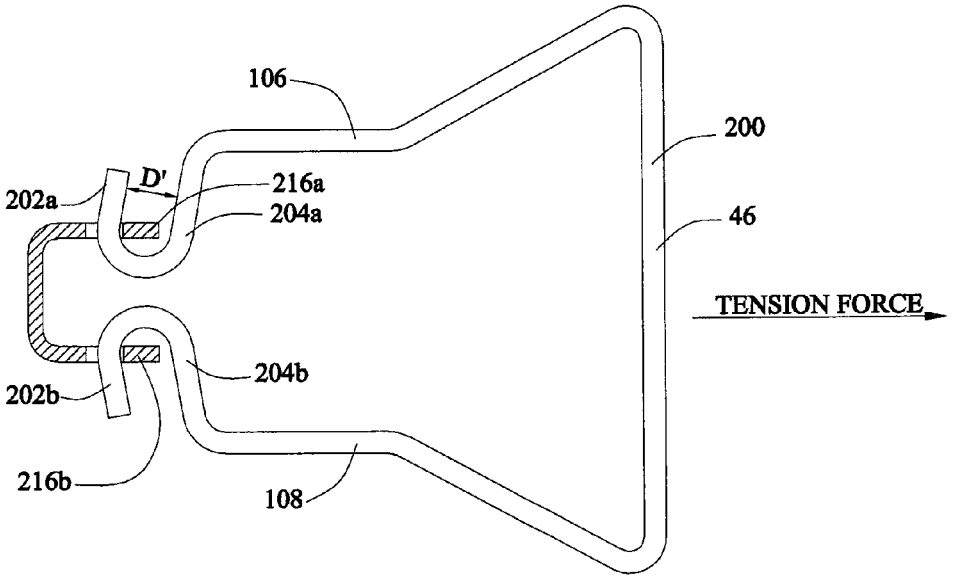

FIGS. 22 and 23 illustrate how the wire tie 200 has similar properties when compressive and tensile forces are applied thereto as indicated in the description of FIGS. 20 and 21, respectively, hereinabove. Indeed, it may be seen that a distance D' between the hook arms 202*a*, 202*b* and the moment arms 204*a*, 204*b*, respectively, stays approximately constant during tension or compression.

Preferably, the wire ties are made from a length of wire having generally uniform density or thickness. It should be noted that one could size the hooks 102*a*, 102*b*, 202*a*, 202*b* or arms 104*a*, 104*b*, 204*a*, 204*b* appropriately depending on the size of the rail or anchor, for either a very tight fit or to allow for some freedom of movement.

Figure 24:
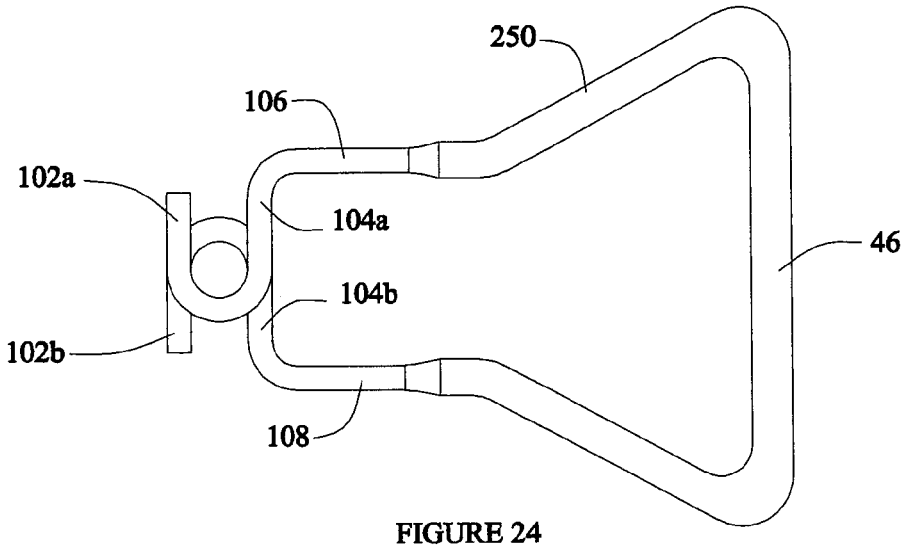
FIGS. 24 and 25 are top plan views of modified embodiments of the wire ties of FIGS. 6 and 16, respectively, in which a mortar embedment portion of the wire tie is flattened.
Figure 25:
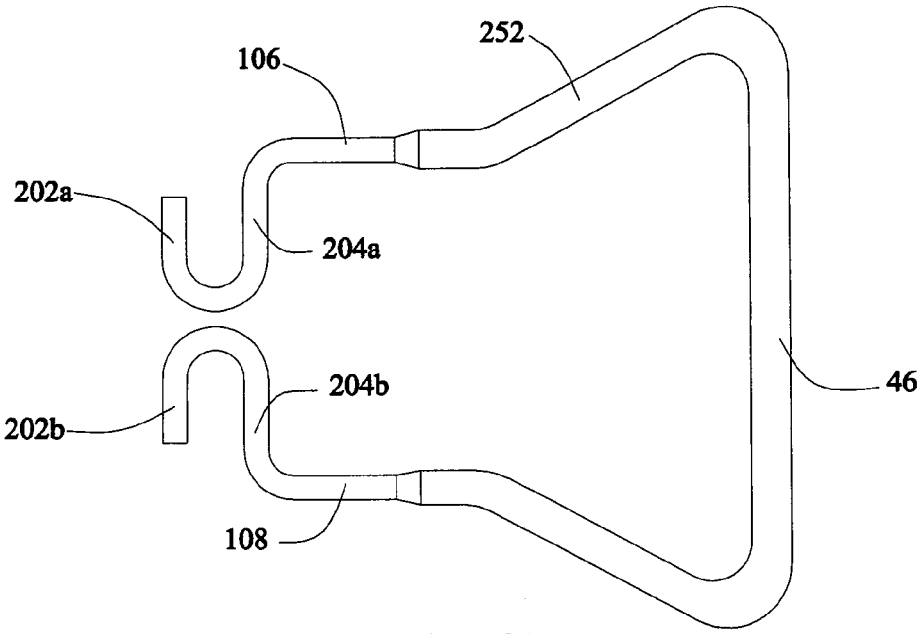
Figure 26:
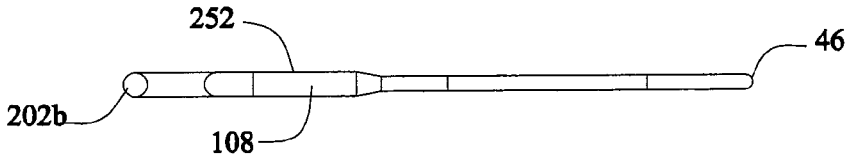
FIG. 26 is a side elevational view of the partly flattened wire tie of FIG. 25.
Figure 27:
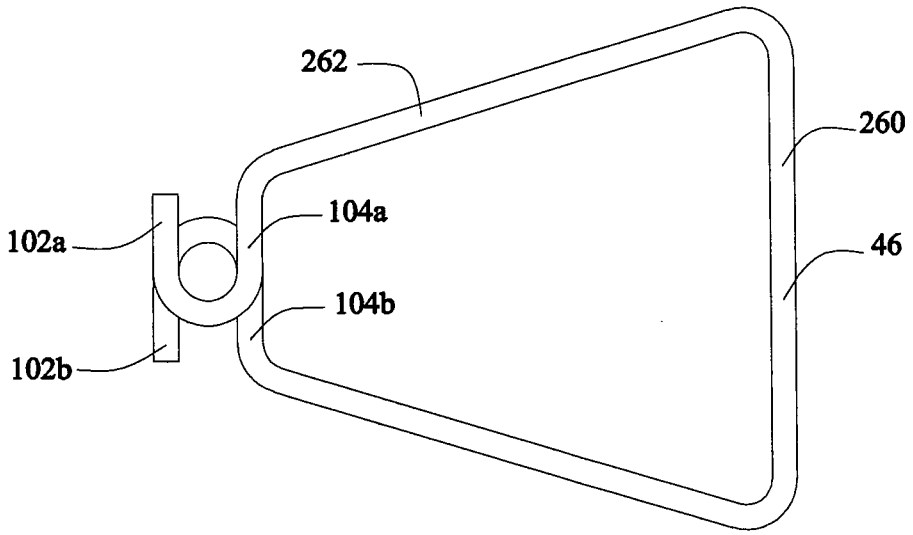
FIGS. 27 and 28 are top plan views of modified embodiments of the wire ties of FIGS. 6 and 16, respectively, having a different wire tie shape.
Figure 28:
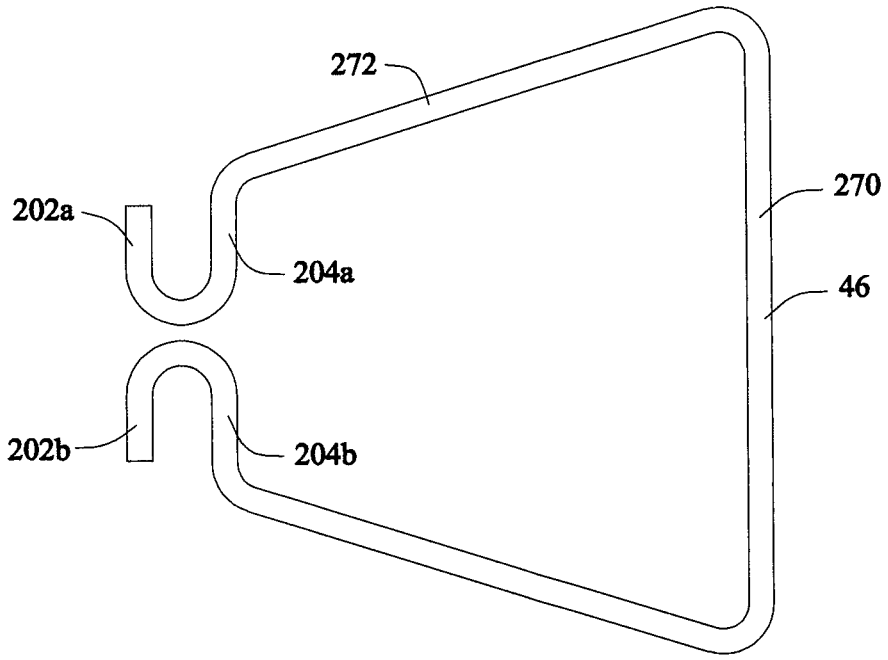

It is anticipated that modifications may be made to any of the wire ties described herein. Referring to FIGS. 24-26, the wire ties 100, 200 could be modified to create wire ties 250 and 252, respectively, having the embedment ends 46 flattened to comply with any regulations requiring the embedment end thickness not to exceed a specific parameter. FIGS. 27 and 28 show that the wire ties 100, 200 may be designed to comprise a variety of shapes. A wire tie 260 shown in FIG. 27 includes an angled leg portion 262 extending between the handle or embedment portion 46 and the moment arm 104*a*. The moment arm 104*a* is deflectable about the angled leg portion 262. Likewise, in FIG. 28, a wire tie 270 includes an angled leg portion 272 between the moment arm 204*a* and the handle or embedment portion 46.

Numerous modifications to the features described and shown are possible. Accordingly, the described and illustrated embodiments are to be construed as merely examples of the inventive concepts expressed herein. Many other shapes of ties or anchors or anchor rails could be used rather than those illustrated. For example, the rail 112 could be replaced with a rail that has a square cross sectional shape or any other shape as desired.

I claim:

1. A wire tie, comprising:

an embedment end having first and second ends, wherein first and second leg portions extend from the first and second ends respectively and do not interlock one another;

first and second moment arms extending directly from the first and second leg portions, respectively, wherein the first and second moment arms extend toward one another, do not interlock one another, and at least partially overlap one another; and first and second hook arms extending directly from the first and second moment arms, respectively, wherein a straight portion of each of the first and second hook arms are parallel to the first and second moment arms, respectively, and at least partially overlap one another and do not interlock one another to enable the first and second hook arms to receive an anchor by deflecting in respective directions substantially perpendicular to a plane of the wire tie when the first and second hook arms are pushed against the anchor, wherein a central, longitudinal axis of the wire tie lies on the plane, wherein the first and second moment arms and the first and second hook arms form opposing U-shaped structures to create an aperture to accept at least a portion of the anchor and each is also capable of coming into direct contact with the anchor.

2. The wire tie of claim 1, wherein the anchor is at least one of an anchor rail, vertical anchor rail, and slotted plate anchor.

3. The wire tie of claim 1, wherein the first and second hook arms are manually deflectable.

4. The wire tie of claim 1, wherein the first and second hook arms are spaced from one another along an axis perpendicular to the plane.

5. The wire tie of claim 1, wherein the straight portions of the first and second hook arms are parallel to one another and to the first and second moment arms, respectively.

6. The wire tie of claim 5, wherein the straight portions of the first and second hook arms define a distal end of the wire tie.

7. The wire tie of claim 5, wherein the first and second moment arms and the first and second hook arms are perpendicular to the anchor to be received after installation.

8. A system, comprising a wire tie as in claim 1 and further comprising: an anchor and a veneer wall, wherein the wire tie connects the veneer wall to the anchor.

9. The wire tie of claim 8, wherein the wire tie is metal and has a diameter of about 3/16 inches to about 1/4 inches.

10. The wire tie of claim 1, wherein a combination of the first moment arm and the first hook arm defines a U-shaped structure and the combination of the second moment arm and the second hook arm defines a second U-shaped structure, wherein open sides of the U-shaped structures oppose one another to form the aperture.

11. The wire tie of claim 1, wherein the wire tie is metal and has a diameter of about 3/16 inches to about 1/4 inches.

12. A wire tie, comprising:

first and second moment arms; and first and second hook arms extending directly from the first and second moment arms, respectively, wherein the first and second moment arms and first and second hook arms, respectively, are separated by a distance D prior to installation of the wire tie, wherein the first and second moment arms and first and second hook arms, respectively, are substantially separated by the distance D after installation, wherein the first and second moment arms extend toward one another and at least partially overlap one another, and wherein no portion of the wire tie interlocks with itself when the first and second hook arms are separated by the distance D prior to installation and after installation, and the first hook arm and the second hook arm each have a curved portion and a straight portion, the straight portions defining distal ends of the wire tie that are parallel to one another, partially overlap one another, and that are parallel to the first and second moment arms, respectively.

13. The wire tie of claim 12, wherein the first and second moment arms and the first and second hook arms are substantially separated by the distance D when the wire tie is under tension.

14. The wire tie of claim 12, wherein the first and second moment arms and the first and second hook arms are substantially separated by the distance D when the wire tie is under compression.

15. The wire tie of claim 12 further including an embedment end opposite of the first and second hook arms, wherein the embedment end is adapted to be embedded within a veneer wall.

16. The wire tie of claim 12, wherein the first and second moment arms and first and second hook arms define an aperture adapted to receive a portion of an anchor therein and are capable of coming into direct contact with the anchor.

17. The wire tie of claim 16, wherein the first and second moment arms and the first and second hook arms are perpendicular to the anchor to be received after installation.

18. The wire tie of claim 17, wherein the straight portions of the first and second hook arms are configured to extend beyond a center line of the anchor after installation.

19. The wire tie of claim 12, wherein the wire tie is metal and has a diameter of about 3/16 inches to about 1/4 inches.

* * * * *